US007832584B2

(12) United States Patent
Eggers et al.

(10) Patent No.: US 7,832,584 B2
(45) Date of Patent: Nov. 16, 2010

(54) BLOW MOLDED TOOL CHEST WITH SLIDING CONNECTOR COMPONENTS

(75) Inventors: Steven Dean Eggers, Clinton, IA (US); Pamela Jo Naeve, Clinton, IA (US); Ronald A. Zimmer, Dewitt, IA (US)

(73) Assignee: Custom-Pak, Inc., Clinton, IA (US)

( * ) Notice: Subject to any disclaimer, the term of this patent is extended or adjusted under 35 U.S.C. 154(b) by 48 days.

(21) Appl. No.: 12/265,317

(22) Filed: Nov. 5, 2008

(65) Prior Publication Data

US 2010/0108549 A1 May 6, 2010

(51) Int. Cl.

| | |
|---|---|
| ***B65D 6/00*** | (2006.01) |
| ***B65D 8/14*** | (2006.01) |
| ***B65D 21/02*** | (2006.01) |
| ***B65D 85/00*** | (2006.01) |

(52) U.S. Cl. ..... 220/7; 206/373; 220/23.83; 312/111

(58) Field of Classification Search ..... 206/372, 206/373; 220/6, 7, 23.83; 312/107, 902, 312/111

See application file for complete search history.

(56) References Cited

U.S. PATENT DOCUMENTS

| | | | | |
|---|---|---|---|---|
| 3,360,180 | A * | 12/1967 | Venturi | 220/7 |
| 3,497,127 | A * | 2/1970 | Box | 220/7 |
| 3,675,808 | A | 7/1972 | Brink | |
| 3,893,740 | A | 7/1975 | England | |
| 4,662,515 | A | 5/1987 | Newby, Sr. | |
| 4,782,619 | A * | 11/1988 | Richards | 312/902 |
| 5,244,265 | A * | 9/1993 | Chiang | 312/107 |
| 6,047,841 | A | 4/2000 | Chen | |
| 6,193,062 | B1 * | 2/2001 | Rysgaard et al. | 220/23.83 |
| 6,264,030 | B1 | 7/2001 | Tsou | |
| 6,422,386 | B1 | 7/2002 | Wiese et al. | |
| 6,612,435 | B1 | 9/2003 | Chang | |
| 6,637,592 | B1 | 10/2003 | Lai | |
| D526,782 | S | 8/2006 | Hosking | |
| 2007/0130737 | A1 | 6/2007 | De La Fuente et al. | |

OTHER PUBLICATIONS

International Search Report and Written Opinion of the International Searching Authority; PCT/US2009/057279; Nov. 13, 2009; 10 pages.

* cited by examiner

*Primary Examiner*—Bryon P Gehman
(74) *Attorney, Agent, or Firm*—St. Onge Steward Johnston & Reens LLC

(57) ABSTRACT

A blow-molded carrying chest which includes an integrally molded frame with a top frame member slideably engaged with the left and right frame members. The frame includes a base frame member, and right and left frame members integrally molded to the base frame member. A top frame member is slideably engaged with the right and left frame members to secure the top frame member and assemble the carrying chest without requiring any fasteners. Below the top frame member is a plurality of drawers which are locked by hinged doors on the right and left frame members that prevent the plurality of drawers from sliding when the carrying chest is in transport.

36 Claims, 8 Drawing Sheets

BLOW MOLDED TOOL CHEST WITH SLIDING CONNECTOR COMPONENTS

FIELD OF THE INVENTION

The present invention relates to a carrying case or chest, and more particularly to a blow-molded tool chest including an integrally molded frame and a top frame member slideably engaged with left and right frame members.

BACKGROUND OF THE INVENTION

The blow molding of cases has been a proven commercial process for many years. Blow molded carrying cases are often used to compartmentalize power tools with accessories or multi-component instrument kits. These blow molded cases have the advantage of being lighter weight than carrying cases made of other materials, as the blow molded designs are lighter than cases made of metals such as steel, titanium, copper, or wood and other heavy materials.

Along with being relatively lightweight, most blow molded carrying cases are integrally compartmented in their interiors to retain and position assortments of contents. Examples of such contents would be various power tools and tools used for day-to-day operations, such as a wrench set, screwdriver, washer, or nails.

In order to meet consumer demand, blow molded carrying cases are mass produced and the efficient and cost effective production of these items is a goal for manufacturers. Various designs and improvements in these blow molded carrying cases provide for advantages, which can decrease manufacturing cost and increase sales, as the advantages provide for better and more user-friendly designs for consumers.

Typically, prior art designs for blow molded cases involve the production of separate parts of the carrying cases. The parts are fastened together with fastening devices such as screws, nails, adhesives, and other such devices. This leads to the production of blow molded carrying cases that involve a series of steps for producing the individual parts, which then involves the additional steps requiring assembly of the carrying case with fasteners. These types of designs are demonstrated by prior art designs such as U.S. Pat. No. 6,637,592 to Lai, which involve the production of a blow molded case whereby two sections of a blow molded frame are fastened together via screws.

Some improved designs have been made to reduce or eliminate the need for fasteners. U.S. Pat. No. 6,422,386 to Weise discloses blow molding a chest whereby the frame parts are integrally molded together. While Weise does not use fasteners for assembly, Weise discloses assembling a frame by having a fixed snapping mechanism that links a barbed portion with a relief portion to hold the frame together.

In addition to fastening a frame of a blow molded carrying case, some prior art designs contain a plurality of separate drawers that are used to store the components of the blow molded carrying cases. These designs, such as Lai, teach the storage of separate components via a plurality of drawers. However, a problem exists whereupon transport of the cases, the drawers may slide open, since there is the lack of a mechanism to prevent the drawers from sliding during transport.

What is desired, therefore, is a blow molded carrying case or chest which is easy and inexpensive to produce relative to known designs, which includes a mechanism to assemble and fasten the frame of the carrying case without requiring fasteners such as screws or adhesives. It is also desirable to provide a carrying case or chest with a mechanism to prevent drawers from sliding out of the frame.

SUMMARY OF THE INVENTION

Accordingly, it is an object of the present invention to provide a blow molded carrying case or chest including a top frame member that slideably engages the frame of the chest to assemble the chest without any fasteners. It is also an object of the present invention to provide such a chest including several drawers and a mechanism to securely hold the drawers closed.

These and other objectives are achieved by providing a blow molded carrying chest including a base frame member, a left frame member and a right frame member attached to the base frame member. Each left and right frame member includes at least one first connector component. The base frame member, the left frame member and the right frame member are molded as a single unit and the left frame member and the right frame member are pivotable with respect to the base frame member. The carrying chest further includes a top frame member, which can be a storage tray. The top frame member includes a body with a left end and a right end, each end containing at least one second connector component. Each of the second connector components is slideably engageable with one of the first connector components. The carrying chest is assembled by the slideable engagement of the at least one first connector component of the right frame member with the at least one second connector component on the right end of the top frame member, and the slideable engagement of the at least one first connector component of the left frame member with the at least one second connector component on the left end of the top frame member. When the first and second connector components are engaged, each of the left and right frame members are retained in an assembled position and secured to the top frame member, which is typically a storage tray.

The top frame member may further include a lid hinged to the body of the top frame member and a handle attached to the lid to facilitate carrying of the chest.

The blow molded carrying chest may further include a plurality of drawers mountable below the top frame member, the drawers slideably mounted upon rails in the left frame member and the right frame member. In some embodiments, the carrying chest includes at least one door hinged to one of the left frame member and the right frame member, adapted to retain the plurality of drawers when the at least one door is closed, and adapted to allow the plurality of drawers to be accessed when the at least one door is open.

In some embodiments, the blow molded carrying chest includes a back frame member. The base frame member, the left frame member and the right frame member, may include grooves for retaining the back frame member.

In a preferred embodiment, each of the left and right frame members includes two or more first connector components, and the top frame member includes two or more second connector components. The slideable engagement of the first and second connector components is preferably conducted in a direction from the back of the chest to the front of the chest.

The first and second connector components may be either a male or female connector components. While the male component can have one of a variety of shapes, a preferred embodiment of the invention contains a male component with a T-shaped design. This T-shaped design contains a vertical member attached to a horizontal member and designed to correspond to a female component.

In some embodiments, each of the first connector components includes an open portion and a lock portion, wherein the open portion is adapted to receive the vertical member of one of the second connector components, and wherein, upon slideable engagement of the top frame member, the vertical member is retained in the lock portion of the first connector component. The lock portion may include an interior cavity for receiving the vertical member, and a top lock member and a bottom lock member defining a channel for slideably receiving the horizontal member.

In some embodiments, the right end and the left end of the top frame member each include at least one tab, wherein each of the tabs engage and is retained in the open portion of one of the first connector components upon slideable engagement of the top frame member. The tabs prevent the top frame member from becoming disengaged with the right and left frame members.

Other objects of the present invention are achieved by a method of assembling a blow molded carrying chest. The method includes the steps of providing a frame including a base frame member, a left frame member and a right frame member attached to the base frame member, wherein the base frame member, the left frame member and the right frame member are molded as a single unit, wherein each of the left frame member and the right frame member contain at least one first connector component. The method further includes providing a top frame member including a body with a right end and a left end, each end containing at least one second connector component, and slideably engaging the second connector components of the right end and the left end of the top frame member with the first connector component of the right frame member and the first component of the left frame member, respectively.

In some embodiments, the method further includes mounting a plurality of drawers into a cavity defined below the top frame member, the drawers slideably mounted upon rails in the left frame member and the right frame member.

The method may further include locking the plurality of drawers into the frame using a set of doors hinged to the left frame member and the right frame member that when in a closed position, lock and retain the plurality of drawers into the frame, and when in an open position, allow the plurality of drawers to be accessed.

Other objects of the invention and its particular features and advantages will become more apparent from consideration of the following drawings and accompanying detailed description.

DETAILED DESCRIPTION OF THE INVENTION

Figure 1:
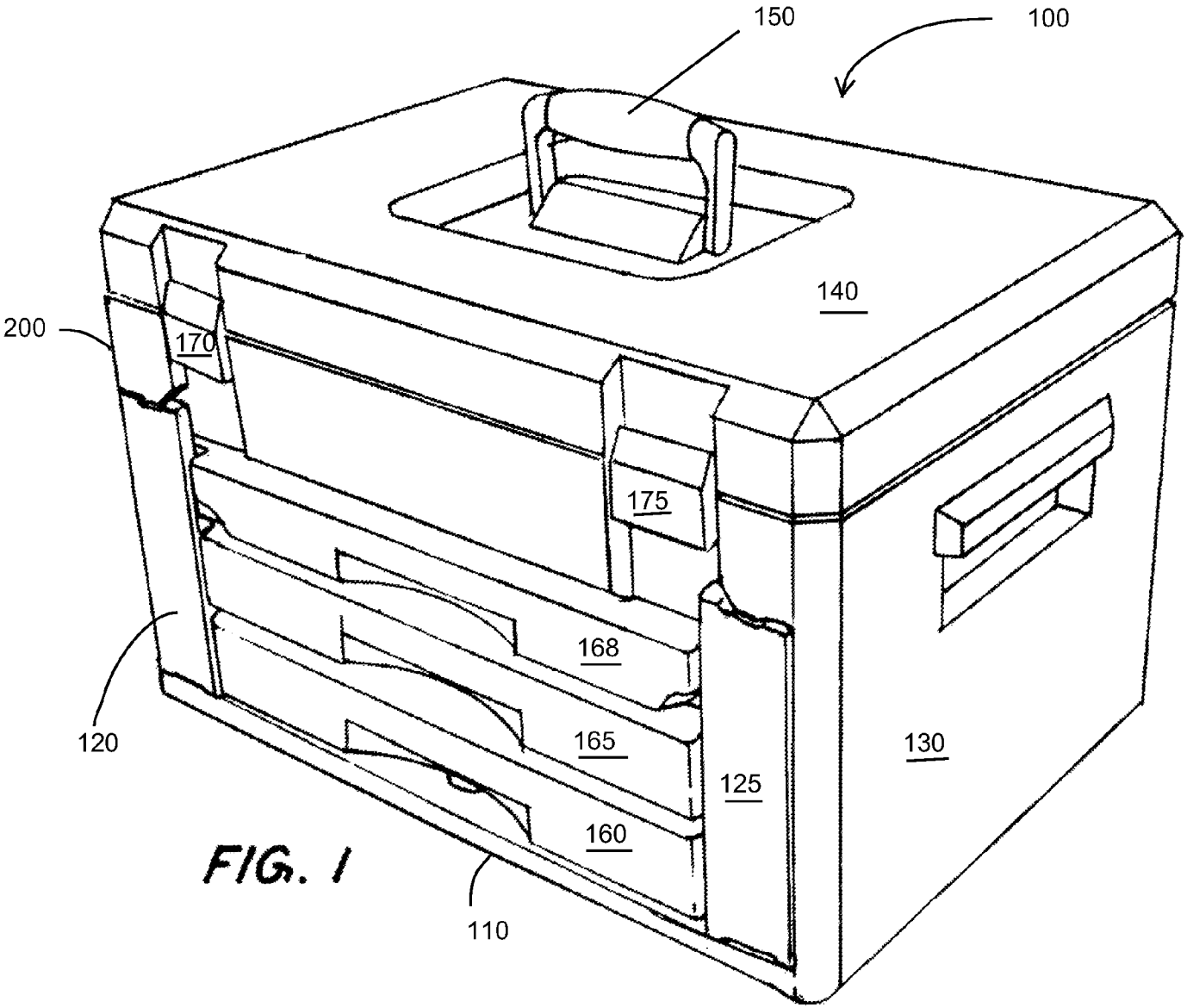
FIG. 1 is a front isometric view of a carrying chest according to an exemplary embodiment of the present invention.
Figure 2:
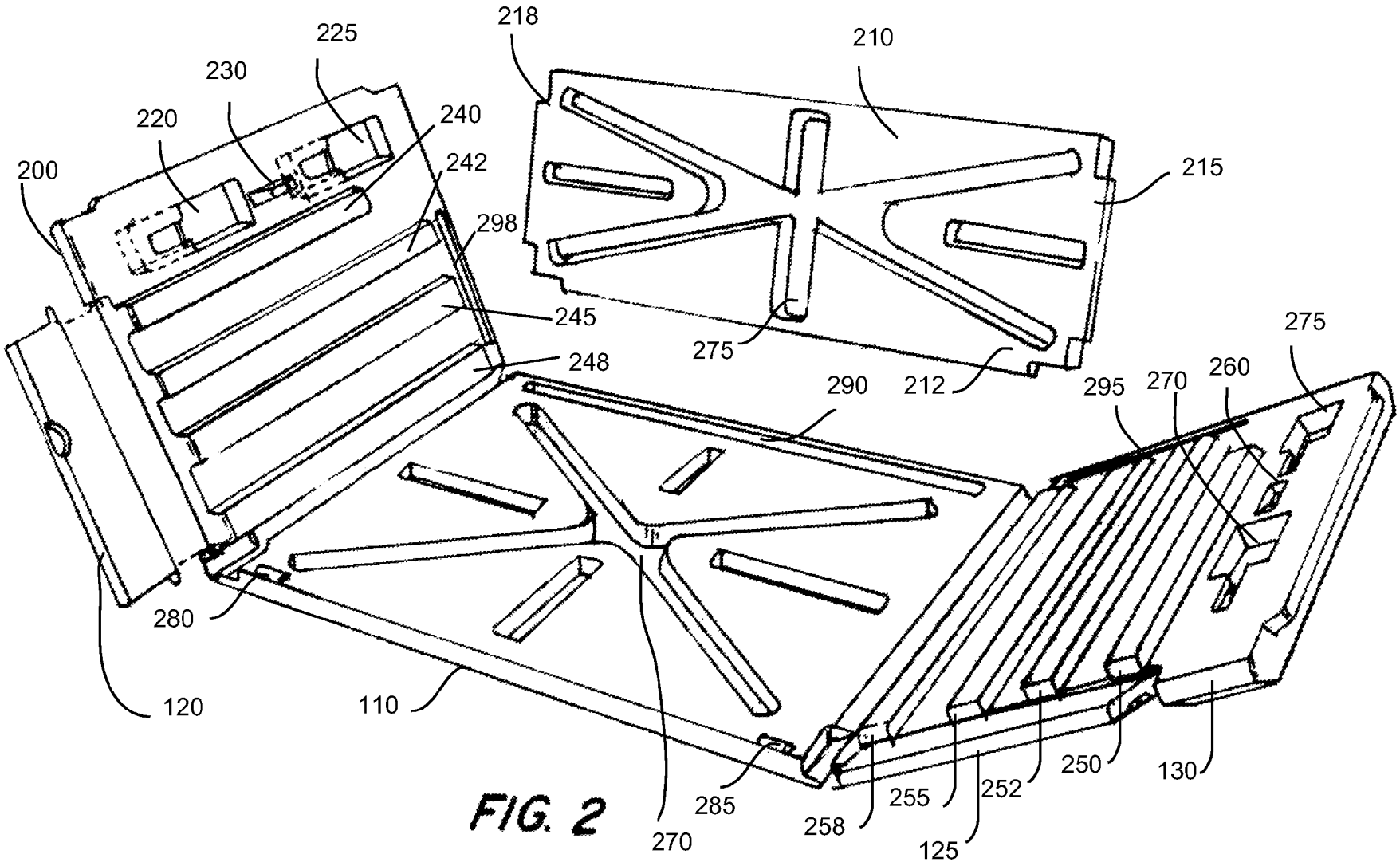
FIG. 2 is an isometric view of the frame members of the carrying chest shown in FIG. 1.

Referring to FIGS. 1 and 2, a blow molded carrying case or chest 100 in accordance with the present invention is shown. The carrying chest 100 includes a base frame member 110 integrally molded with a right frame member 130 and a left frame member 200. In the exemplary embodiment, the base frame member 110 includes hollowed out portions 270 to reduce weight and bulk of the carrying chest 100 (shown in FIG. 2). The carrying chest 100 further includes a top frame member 140 with a handle 150 attached to the top frame member 140. The top frame member 140, which can be a storage tray, includes one or more clasps 170 and 175 to secure a hinged top lid of the storage tray 140.

The chest 100 further includes a plurality of drawers 160, 165, and 168. Hinged doors 120 and 125 are connected to the left and right frame members to secure the plurality of doors 160, 165, and 168 in a closed position.

FIG. 2 is an exploded isometric view the carrying chest 100 shown in FIG. 1. The base frame member 110, right frame member 130 and left frame member 200 are preferably, but not necessarily, blow molded as one integral piece whereby the right frame member 130 and left frame member 200 are each pivotable with respect to the base frame member 110. The left and right frame members each include a plurality of rails to hold the drawers 160/165/168. For example, on the left frame member 200, rails 240, 242, 245, and 248 are shown. The right frame member 130 includes rails 250, 252, 255, and 258.

The carrying case 100 includes a back frame member 210 secured between the base, right and left frame members. In some embodiments, the back frame member 210 contains hollowed out portions 275 which are incorporated in order to reduce weight and bulk of the carrying chest 100. The hollowed out portions 275 are of little sacrifice to rigidity of the carrying chest 100. In preferred embodiments, the back frame member 210 extends up to the bottom of the top frame member 140, rather than extending up to the top of the chest and adjacent to the back of the top frame member 140. This arrangement also contributes to a reduction in weight and bulk of the carrying chest 100.

The back frame member 210 includes several elongated protrusions 212, 215, and 218, which correspond to grooves 290, 295, and 298 on base frame member 110, right frame member 130, and left frame member 200, respectively. The protrusions of the back frame member 210 engage the grooves during assembly to secure the back frame member 210.

Each of the left frame member 200 and the right frame member 130 include one or more first connector components. In the exemplary embodiment, the first connector components are female connector components 220 and 225 on the left frame member 200 and female connector components 270 and 275 on the right frame member 130. The first connector components receive and/or slideably engage with second connector components of the top frame member 140, in order to assemble the carrying chest 100. Each of the left and right frame members further includes an indentation 230/260 to receive a tab on the top frame member 140. Upon slideable engagement of the top frame member 140, the tabs are retained in open portions of the female connectors 270 and 220 to lock the top frame member 140 in an assembled position.

FIG. 2 further illustrates the hinged doors 120 and 125. The hinged doors 120 and 125 are pivotably connected to the left and right frame members, respectively. In the exemplary embodiment, the base frame member 110 includes tabs 280 and 285. These tabs 280 and 285 secure the hinged doors 120 and 125 to retain the plurality of drawers 160, 165, and 168 in a closed position.

Figure 3:
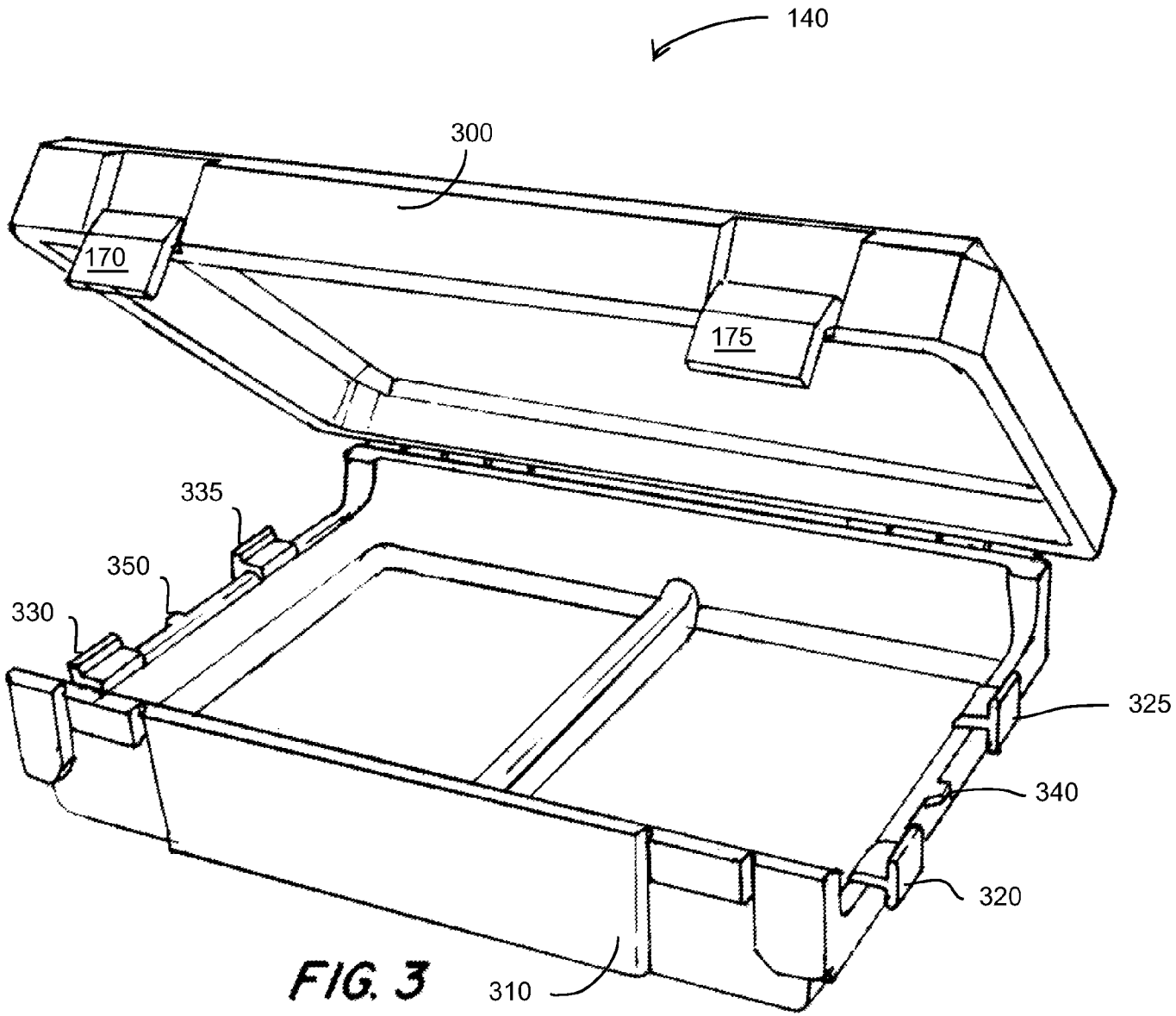
FIG. 3 is an isometric view of a storage tray of the carrying chest shown in FIG. 1.

FIG. 3 shows a detailed view of the top frame member 140 of the invention. In the exemplary embodiment, the top frame member 140 includes a hinged lid or cover 300 and a body 310. Clasps 170 and 175 lock the cover 300 of the top frame member 140 to the body 330 in a closed position. In some other embodiments, the top frame member 140 is a single top member without a lid or tray. The body 310 includes several second connector components on left and right ends of the body 310. In the exemplary embodiment, the body 310 includes male connector components 320 and 325 on the right end, and male connector components 330 and 335 on the left end of the body 310. The second connector components of the body 310 slideably engage with the first connector components of the left and right frame members to assemble the carrying chest 100. The body 310 further includes the tabs 340/350 for locking the top frame member 140 in the assembled position.

Figure 4:
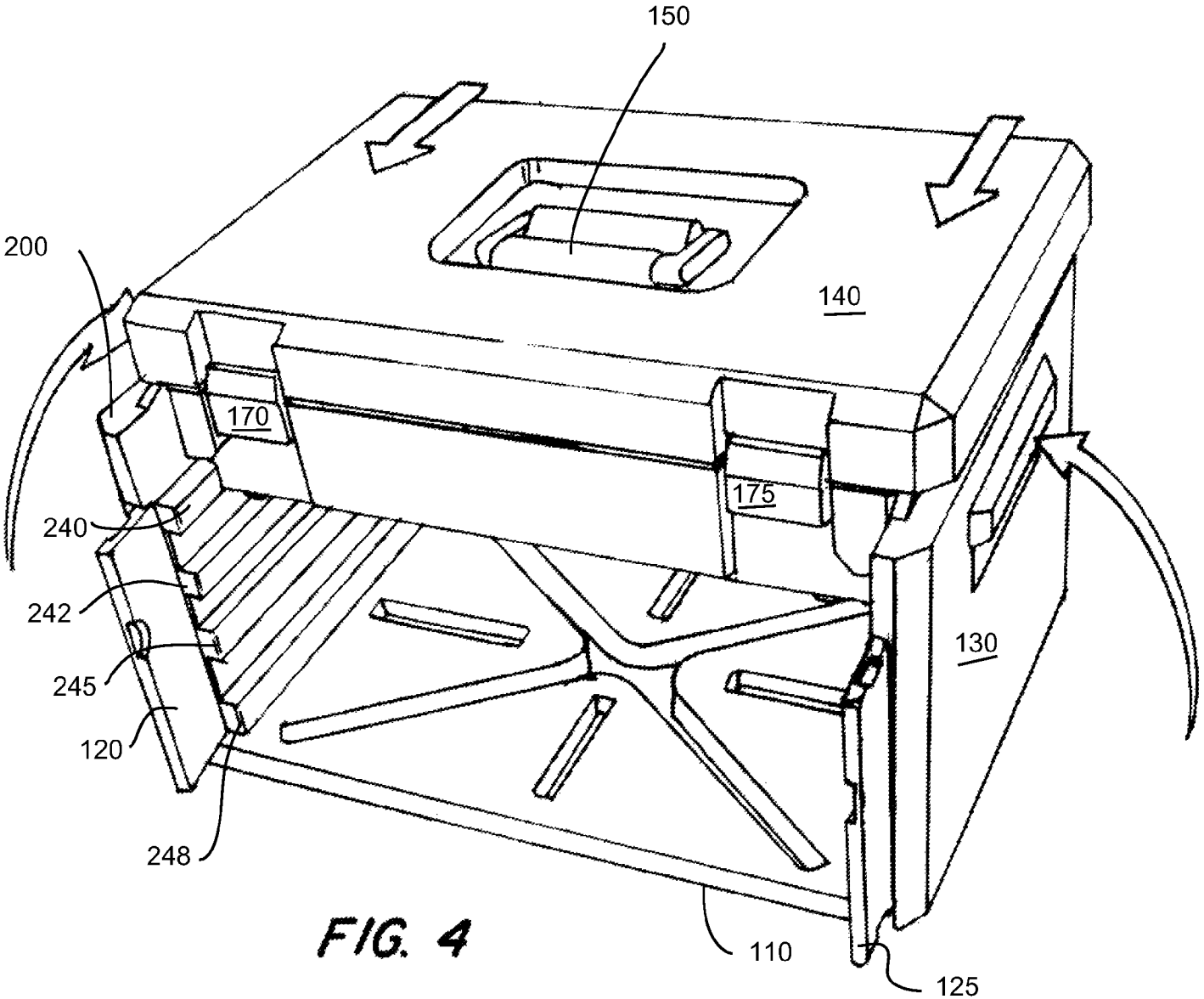
FIG. 4 a front isometric view of a carrying chest shown in FIG. 1 illustrating the assembly of the carrying chest.

FIG. 4 a front isometric view of the carrying chest 100 illustrating the assembly of the carrying chest 100. To assemble the carrying chest 100, the left and right frame members 200/130 are pivoted to be approximately ninety (90) degrees with respect the base member 110 while the back frame member 210 is placed between the left, right and base frame members. During assembly, the second connector components of top frame member 140 are inserted into the first connector components of the left and right frame members 200/130. The top frame member 140 is then slid forward to slideably engage the first and second connector components and secure the top frame member 140 to the left and right frame members 200/130.

Figure 5:
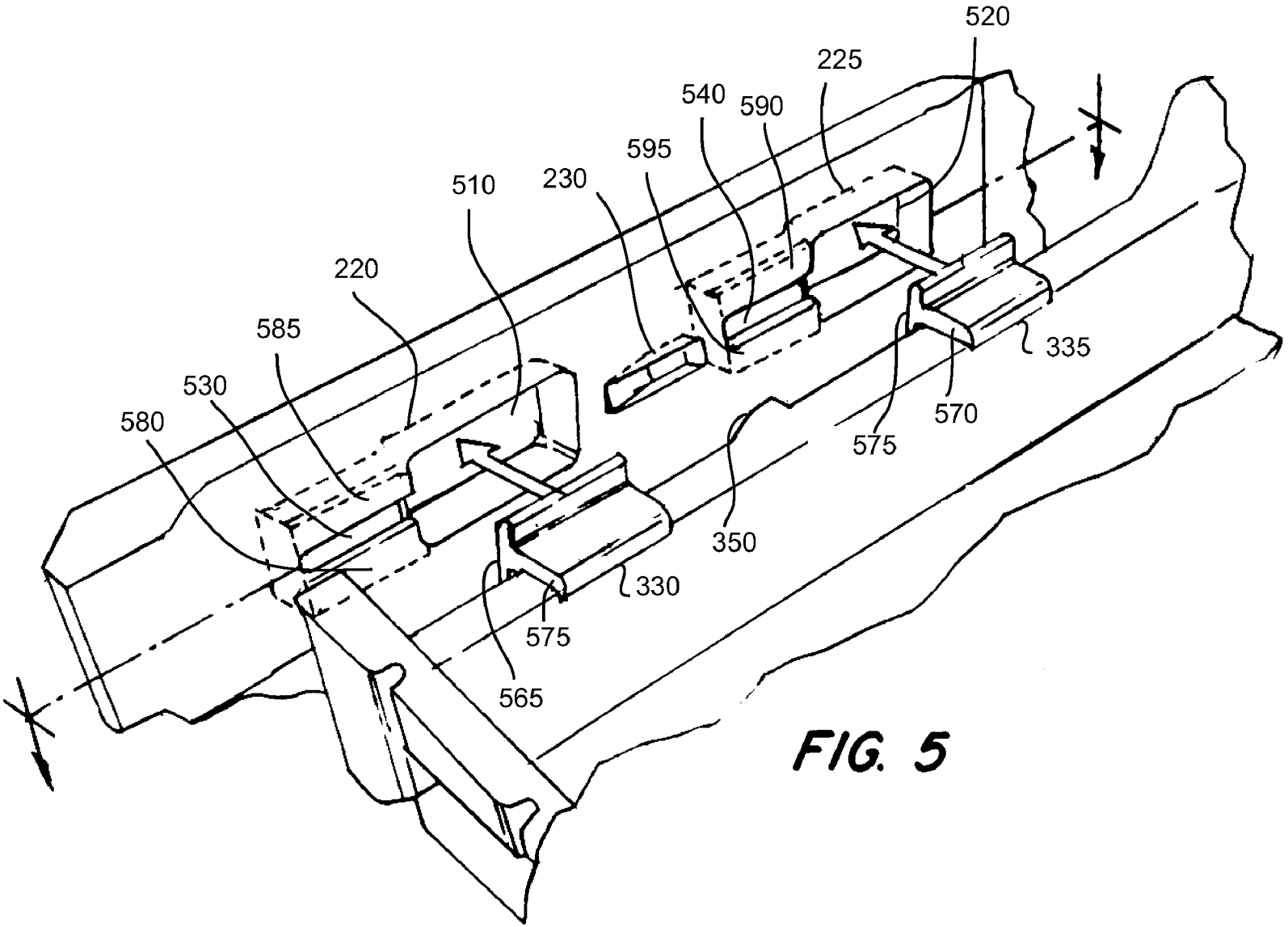
FIG. 5 is an isometric view of the assembly of the carrying chest illustrating the slideable engagement of the storage tray with frame members of the carrying chest.

Referring now to FIG. 5, a detailed view of the engagement between the body 310 and the left and right frame members 200/130 is shown. In the exemplary embodiment, male connector components 330 and 335 comprise a T-shaped structure including vertical members 565 and 575, and horizontal members 560 and 570. The vertical members 565 and 575 are attached to horizontal members 560 and 570 to form the T-shape.

The male connector components 300/335 are inserted into open portions 510/520 of keyed female connector components 220/225. The open portions 510/520 include an opening with a size and shape approximately equal to or slightly larger than the vertical members 565/575. When the male connectors 300/335 are in the open portions 510/520, the tab 350 fits into an indentation 230.

To engage the locking mechanism of the invention, the male components 330/335 are slid horizontally into locking portions 530/540 of the female components 220/225. Each of the locking portions 530/540 includes a rear interior cavity with a size and shape approximately equal to or slightly larger than the vertical members 565/575. The locking positions 530/540 further include exterior portions adapted to receive the horizontal members 560/575 between top and bottom lock members 580, 585, 590, and 595. The vertical members 565/575 of the male connector components 330/335 slide behind the locked members 580, 585, 590, and 595 into the interior cavity.

Figure 5A:
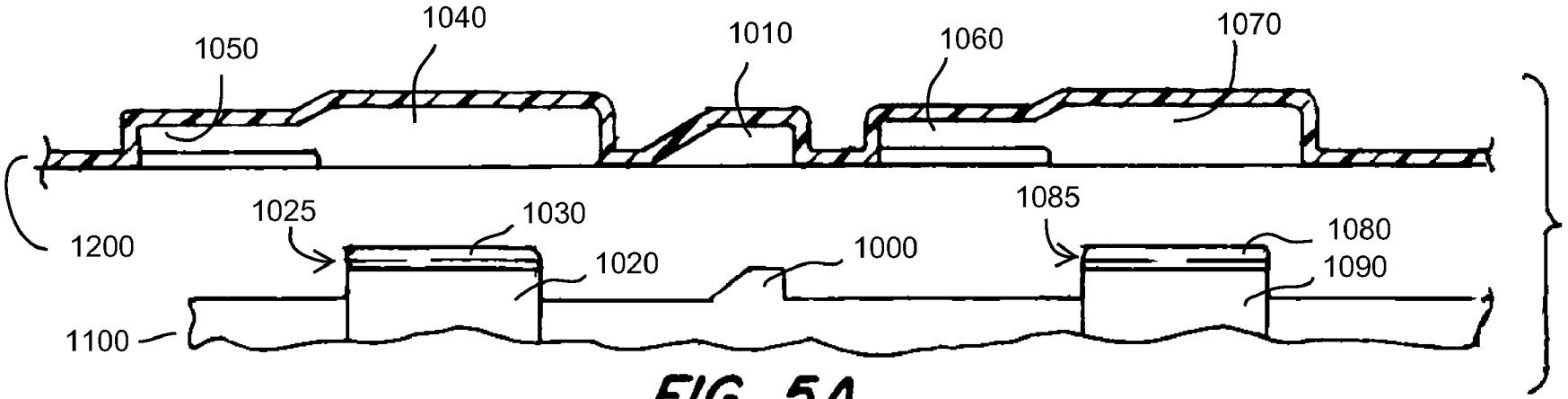
FIGS. 5A-5C are top detail views illustrating the slideable engagement of the storage tray with frame members of the carrying chest shown in FIG. 5.
Figure 5B:
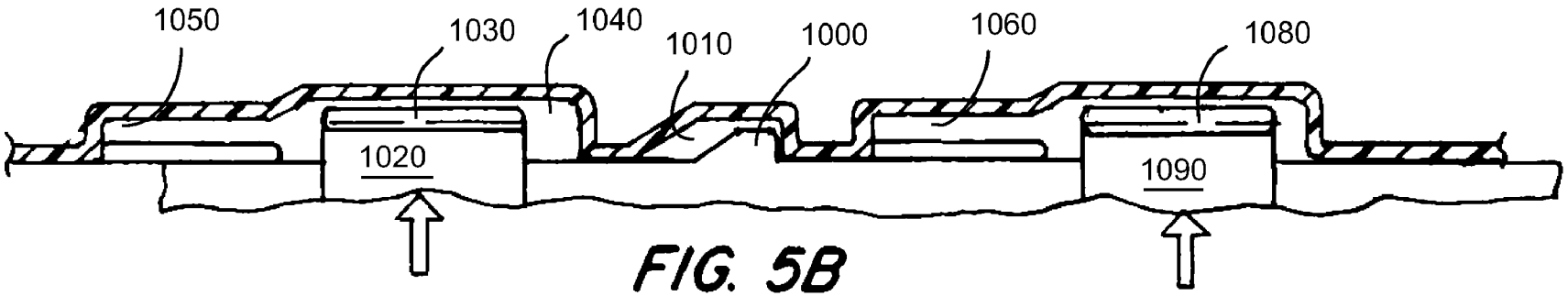
Figure 5C:
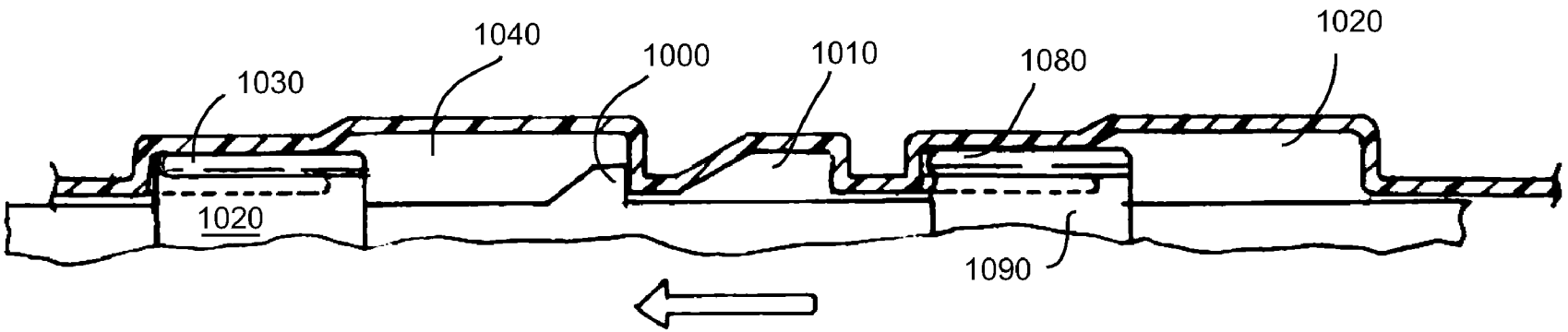

FIGS. 5A-5C show detailed top views of the engagement between the tray body 330 and the left frame member 200. FIG. 5A shows male connector components 1025 and 1085 being aligned with open positions 1040 and 1070. The tab 1000 is aligned with the indentation 1010 in the left frame member.

FIG. 5B is shows the male connector components inserted into the open portion of the female connector components. Vertical members 1030 and 1080 are shown inserted into female members 1040 and 1070. Tab 1000 is inserted into indentation 1010. Additionally, the top frame member 1100 and the frame member 1200 are shown to be set against each other.

FIG. 5C is a view of a male connector components engaged with the female components in the locked position. Here, vertical members 1030 and 1080 are engaged with female connector components 1050 and 1060 and locked in the interior cavities. The tab 1000 is moved from indentation 1010 to fit into the open portion 1040. The tab 1000 includes a ramped front edge and a flat rear edge. Therefore, upon sliding into the open portion 1040, the tab 1000 becomes permanently or semi-permanently locked in position. This locks the male connector components into the female connector components and prevents the top frame member 1100 from sliding.

The slideable engagement of the top frame member 140 with each of the left and right frame members 200/130 provides for easy assembly of the carrying chest without requiring any fasteners. In some embodiments, the present invention includes a kit comprised of the frame members 140/200/130 and drawers 160/165/168 that may be shipped unassembled to customers. Shipping in an unassembled or flat configuration allows for a reduction in shipping volume and cost. The carrying chest according to the present invention may then be assembled upon receipt by slideably engaging the top frame member 140 with each of the left and right frame members 200/130 as described herein.

Figure 6A:
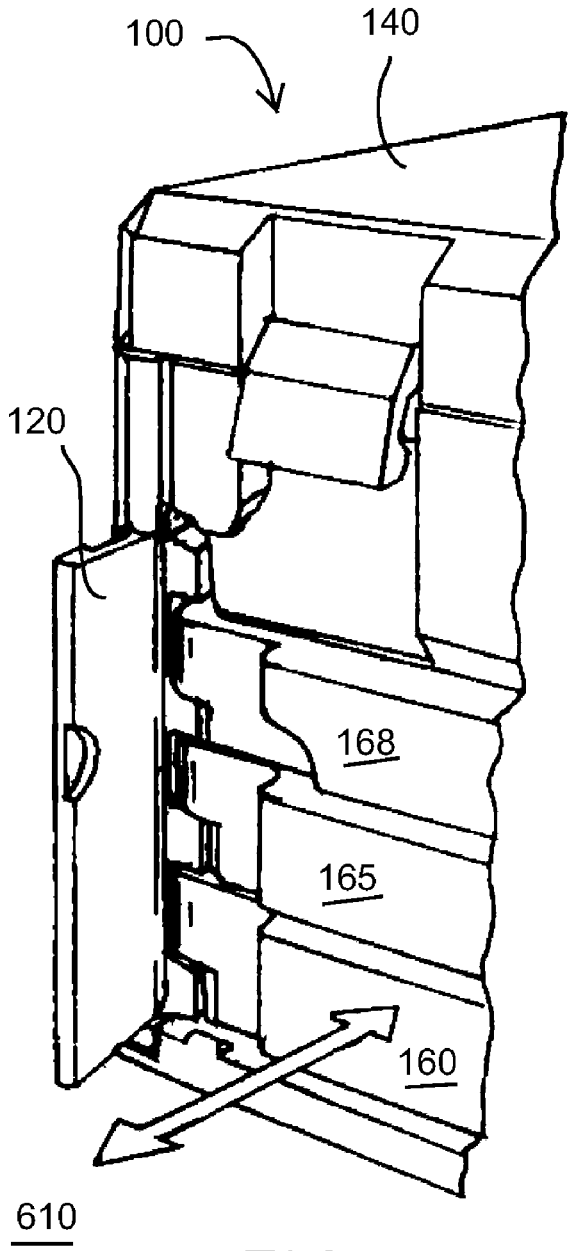
FIGS. 6A-6B are isometric detail views illustrating a hinged door for securing a plurality of drawers in the carrying chest.
Figure 6B:
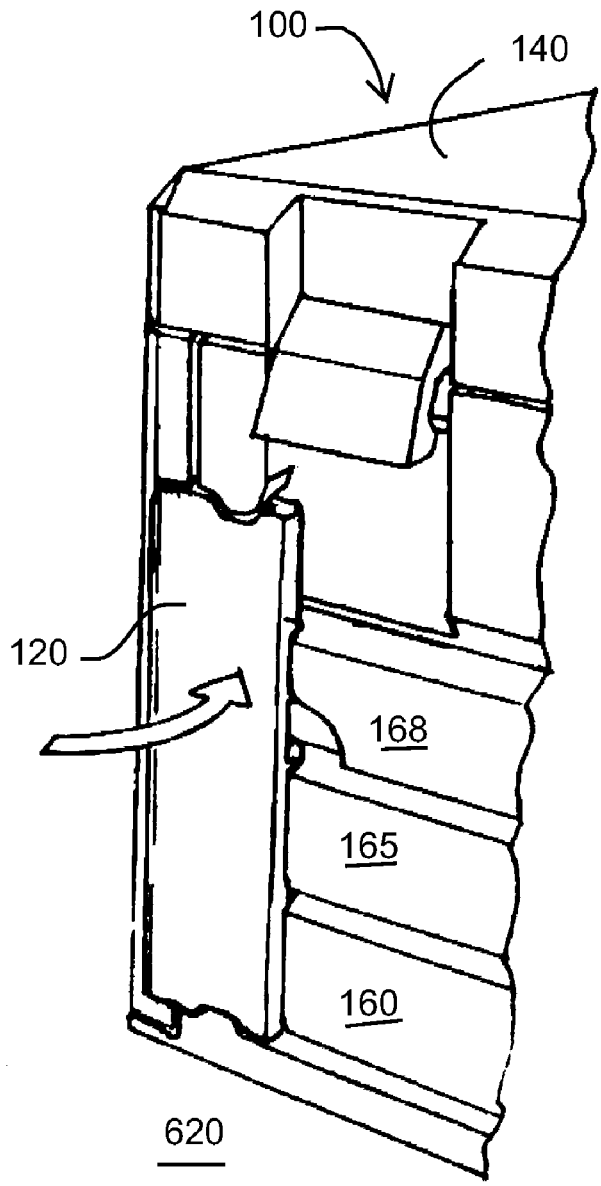

FIGS. 6A and 6B show a detailed view of the open 610 and closed 620 position of the hinged door 120 located on the left frame member. The hinged door pivots about an axis through the left frame member and locks the plurality of drawers 160, 165, and 168 located underneath the top frame member 140 in a closed position. This prevents the drawers from sliding during transport of the carrying chest 100.

FIG. 6A shows the hinged door 120 in open position 610, which allows plurality of drawers 160, 165, and 168 to be accessed. FIG. 6B shows the hinged door in closed position 620, preventing the access to the plurality of drawers 160, 165, and 168.

While the invention has been specifically described in connection with certain specific embodiments thereof, it is to be understood that this is by way of illustration and not of limitation and that various changes and modifications in form and details can be made thereto, and the scope of the appended claims should be construed as broadly as the prior art will permit.

What is claimed is:

1. A blow molded carrying chest, comprising:

a base frame member;

a left frame member and a right frame member, wherein each of the left and right frame members includes at least one first connector component;

a top frame member, said top frame member comprising a body with a left end and a right end, each end containing at least one second connector component, wherein each of the second connector components is slideably engaged with respect to one of the first connector components; and wherein the at least one first connector component of the right frame member is slideably engaged with respect to the at least one second connector component on the right end of said top frame member, and at least one first connector component of the left frame member is slideably engaged with respect to the at least one second connector component on the left end of the top frame member, wherein the at least one first connector component of the right frame member engages the at least one second connector component on the right end of said top frame member in one direction and slides in a different direction and wherein the at least one first connector component of the left frame member engages the at least one second connector component on the left end of said top frame member in one direction and slides in a different direction to secure the top frame member with each of said left and right frame members.

2. The blow molded carrying chest of claim 1, wherein said base frame member, said left frame member and said right frame member are molded together as a single unit, and said left frame member and a right frame member are pivotably attached to said base frame member.

3. The blow molded carrying chest of claim 1, wherein said top frame member is a storage tray.

4. The blow molded carrying chest of claim 1, wherein each of said left and right frame members include two or more said first connector components, and wherein said top frame member includes two or more said second connector components.

5. The blow molded carrying chest of claim 1, further comprising a plurality of drawers mountable below said top frame member, said plurality of drawers slideably mounted upon rails in said left frame member and said right frame member.

6. The blow molded carrying chest of claim 5, further comprising at least one door hinged to one of said left frame member and said right frame member, said at least one door adapted to retain said plurality of drawers when said at least one door is closed, and adapted to allow said plurality of drawers to be accessed when said at least one door is open, and wherein said plurality of drawers are indented to allow said at least one door to form a flat wall with said plurality of drawers.

7. The blow molded carrying chest of claim 6, wherein a first said door is hinged to said left frame member and a second said door is hinged to the right frame member.

8. The blow molded carrying chest of claim 6, wherein said base frame member includes at least one tab for securing said at least one door in a closed position.

9. The blow molded carrying chest of claim 1, wherein said first connector components are female connector components, and said second connector components are male connector components.

10. The blow molded carrying chest of claim 1, wherein said first connector components are male connector components, and said second connector components are female connector components.

11. The blow molded carrying chest of claim 1, further comprising a back frame member.

12. The blow molded carrying chest of claim 11, further comprising grooves formed in said base frame member, said left frame member and said right frame member, wherein said left frame member and said right frame member are substantially perpendicular to said base frame member, and said back frame member is retained in said grooves.

13. The blow molded chest of claim 11, wherein said back frame member is adjacent to a bottom of said top frame member.

14. The blow molded carrying chest of claim 1, wherein the slideable engagement is conducted in a direction from a back of said carrying chest to a front of said carrying chest.

15. The blow molded carrying chest of claim 1, wherein each of said second connector components includes a horizontal member and a vertical member attached to a distal end of the horizontal member.

16. The blow molded carrying chest of claim 15, wherein each of said first connector components includes an open portion and a lock portion;

wherein the open portion is adapted to receive the vertical member of one of the second connector components; and upon the slideable engagement, the vertical member of one of said second connector components is retained in the lock portion of one of the first connector components.

17. The blow molded carrying chest according to claim 16, wherein the lock portion of each of said first connector components includes an interior cavity for receiving the vertical member of one of the second connector components, and a top lock member and a bottom lock member define a channel for slideably receiving the horizontal member of one of the second connector components.

18. The blow molded carrying chest of claim 16, wherein said right end and said left end of said top frame member each comprise at least one tab, wherein the at least one tab engages and is retained in the open portion of one of the first connector components upon slideable engagement of said top frame member.

19. The blow molded carrying chest of claim 18, wherein said tabs prevent said top frame member from becoming disengaged with said right and left frame members.

20. The blow molded carrying chest of claim 1, wherein said base frame member, said top frame member, said left frame member and said right frame member are connected to one another without any other fasteners.

21. The blow molded carrying chest of claim 1, further comprising a lid hinged to said top frame member.

22. The blow molded carrying chest of claim 21, further comprising a handle attached to said lid to facilitate carrying of said chest.

23. The blow molded carrying chest of claim 1, wherein said base frame member, left frame member, and right frame member define a drawer cavity; and wherein said drawer cavity includes a plurality of drawers, each of said plurality of drawers slideable between a retracted position wherein the drawer is located within the drawer cavity and an extended position wherein at least a portion of the drawer is protruding from the drawer cavity to provided access to the drawer.

24. The blow molded carrying chest of claim 1, wherein said base frame member defines a rectangular surface having portions thereof removed in order to reduce weight and bulk of said chest.

25. The blow molded carrying chest of claim 1, wherein said base frame member contains at least two indentations in order to reduce weight and bulk of said chest.

26. A blow molded carrying chest, comprising:

a base frame member;

a left frame member and a right frame member, wherein said base frame member, said left frame member and said right frame member are molded together as a single unit and said left frame member and a right frame member are pivotably attached to said base frame member, wherein each of the left and right frame member includes at least one first connector component;

a storage tray, said storage tray comprising a body with a left end and a right end, each end containing at least one second connector component, and a lid hingedly attached to the body, wherein each of the second connector components is slideably engaged with respect to one of the first connector components;

a plurality of drawers mounted below said top frame member, said drawers slideably mounted upon rails in said left frame member and said right frame member;

at least one door hinged to one of said left frame member and said right frame member, said at least one door adapted to retain said plurality of drawers when said at least one door is closed, and adapted to allow said plurality of drawers to be accessed when said at least one door is open; and wherein the at least one first connector component of the right frame member is slideably engaged with respect to the at least one second connector component on the right end of the body, and at least one first connector component of the left frame member is slideably engaged with respect to the at least one second connector component on the left end of the body, wherein the at least one first connector component of the right frame member engages the at least one second connector component on the right end of said top frame member in one direction and slides in a different direction and wherein the at least one first connector component of the left frame member engages the at least one second connector component on the left end of said top frame member in one direction and slides in a different direction to secure the storage tray with each of said left and right frame members.

27. A method of assembling a blow molded carrying chest comprising the steps of:

providing a frame comprising a base frame member, a left frame member and a right frame member attached to said base frame member, wherein each of said left frame member and said right frame member contain at least one first connector component;

providing a top frame member with a right end and a left end, each end containing at least one second connector component; and securing via sliding said at least one connector component of each of said right end and said left end of said top frame member with said at least one first connector component of said right frame member and said at least one first component of said left frame member, respectively wherein the at least one second connection components respectively engage the at least one first connector components in one direction and then slide in a different direction.

28. The method of claim 27, wherein said base frame member, said left frame member and said right frame member are integrally molded as a single unit, and wherein said left frame member and said right frame member are pivotable to said base frame member.

29. The method of claim 27, wherein said top frame member is a storage tray.

30. The method of claim 27, further comprising the steps of:

inserting said at least one second connector component of said right end of said top frame member into said at least one first connector component of said right frame member, and inserting said at least one second connector component of said left end of said top frame member into said at least one first connector component of said left frame member, and locking said top frame member into place by sliding said second connector components of said left end and said right end of said top frame member whereby said second connector components are engaged with said first connector components.

31. The method of claim 27, further comprising the step of pivoting said left frame member and said right frame member about integrally molded hinges such that said left frame member and said right frame member are substantially perpendicular to said base frame member.

32. The method of claim 27, further comprising the step of mounting a plurality of drawers into a cavity defined below said top frame member, said drawers slideably mounted upon rails in said left frame member and said right frame member.

33. The method of claim 32, further comprising the step of locking said plurality of drawers into said frame using a set of doors hinged to said left frame member and said right frame member that when in a closed position, lock and retain said plurality of drawers into said frame, and when in an open position, allow said plurality of drawers to be accessed.

34. The method of claim 27 further comprising the step of inserting a back frame member into grooves formed in said base frame member, said left frame member and said right frame member.

35. The method of claim 27, wherein said step of securing via sliding said left frame member to said top frame member and said right frame member to said top frame member is conducted in a direction from a back of the chest to a front.

36. The method of claim 27, further comprising the step of attaching a handle to said top frame member to facilitate carrying of said chest.

* * * * *